US011211736B2

(12) United States Patent
Kon

(10) Patent No.: US 11,211,736 B2
(45) Date of Patent: Dec. 28, 2021

(54) CONNECTOR

(71) Applicant: SUMITOMO WIRING SYSTEMS, LTD., Mie (JP)

(72) Inventor: Akihiro Kon, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/031,766

(22) Filed: Sep. 24, 2020

(65) Prior Publication Data

US 2021/0119368 A1 Apr. 22, 2021

(30) Foreign Application Priority Data

Oct. 18, 2019 (JP) ..... JP2019-190670

(51) Int. Cl.
*H01R 13/506* (2006.01)
*H01R 13/52* (2006.01)
*H01R 13/629* (2006.01)

(52) U.S. Cl.
CPC ..... *H01R 13/506* (2013.01); *H01R 13/5208* (2013.01); *H01R 13/62938* (2013.01)

(58) Field of Classification Search
CPC ..... H01R 13/5208; H01R 13/62938; H01R 13/506
See application file for complete search history.

(56) References Cited

U.S. PATENT DOCUMENTS 5,971,791 A * 10/1999 Itoh ..... H01R 13/5202 439/364
7,249,958 B2 * 7/2007 Ishikawa ..... H01R 13/631 439/141
10,355,412 B2 * 7/2019 Matsuura ..... H01R 13/743

FOREIGN PATENT DOCUMENTS

JP H08-330021 A 12/1996
JP 2001-217033 A 8/2001

* cited by examiner

*Primary Examiner* — Briggitte R. Hammond
(74) *Attorney, Agent, or Firm* — Abelman, Frayne & Schwab

(57) ABSTRACT

A connector is provided with a housing 10, a grommet 40 arranged to cover an outer periphery of the housing 10, and a grommet cover 60 arranged to cover an outer periphery of the grommet 40. The grommet cover 60 includes a tip portion 74 on one end on an opening side. The housing 10 includes a restricting portion 14, 14E. The restricting portion 14, 14E includes a recess 15, 15E inside which the tip portion 74 of the grommet cover 60 is to be arranged. The recess 15, 15E of the restricting portion 14, 14E includes a restricting body 19 arranged to face an outer side of the tip portion 74 of the grommet cover 60.

5 Claims, 7 Drawing Sheets

CONNECTOR

CROSS-REFERENCE TO RELATED APPLICATIONS

This application is based on and claims priority from Japanese Patent Application No. 2019-190670, filed on Oct. 18, 2019, with the Japan Patent Office, the disclosure of which is incorporated herein in its entirety by reference.

TECHNICAL FIELD

The present disclosure relates to a connector.

BACKGROUND

A connector disclosed in Japanese Patent Laid-open Publication No. H08-330021 includes a housing, a grommet to be mounted on the back surface of the housing and a grommet cover to be mounted on the housing to cover the grommet. A locking portion is provided on an outer side surface of the housing. The locking pin is provided with a groove. A locking hole is provided in a side wall of the grommet cover. A protrusion shaped to project on an inner peripheral edge part of the locking hole is provided on the side wall of the grommet cover. A thickness of the protrusion is equal to an opening width of the groove.

The grommet cover is slid and mounted on the housing. When the grommet cover reaches a proper mount position with respect to the housing, the protrusion is fit into the groove of the locking pin. In this way, opening deformation of the grommet cover is prevented. Note that a connector with a grommet and a grommet cover of this type is also disclosed in Japanese Patent Laid-open Publication No. 2001-217033.

SUMMARY

In the case of Japanese Patent Laid-open Publication No. H08-330021, the locking pin has to be forcibly inserted into a loose fitting hole continuous with the locking hole when the grommet cover is mounted. Thus, workability has been poor.

Accordingly, the present disclosure aims to provide a connector capable of preventing the deformation of a grommet cover while ensuring good assemblability.

The present disclosure is directed to a connector with a housing, a grommet arranged to cover an outer periphery of the housing, and a grommet cover arranged to cover an outer periphery of the grommet, wherein the grommet cover includes a tip portion on one end on an opening side, the housing includes a restricting portion, the restricting portion includes a recess, the tip portion of the grommet cover being arranged inside the recess, and the recess of the restricting portion includes a restricting body arranged to face an outer side of the tip portion of the grommet cover.

According to the present disclosure, it is possible to provide a connector capable of preventing the deformation of a grommet cover while ensuring good assemblability.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
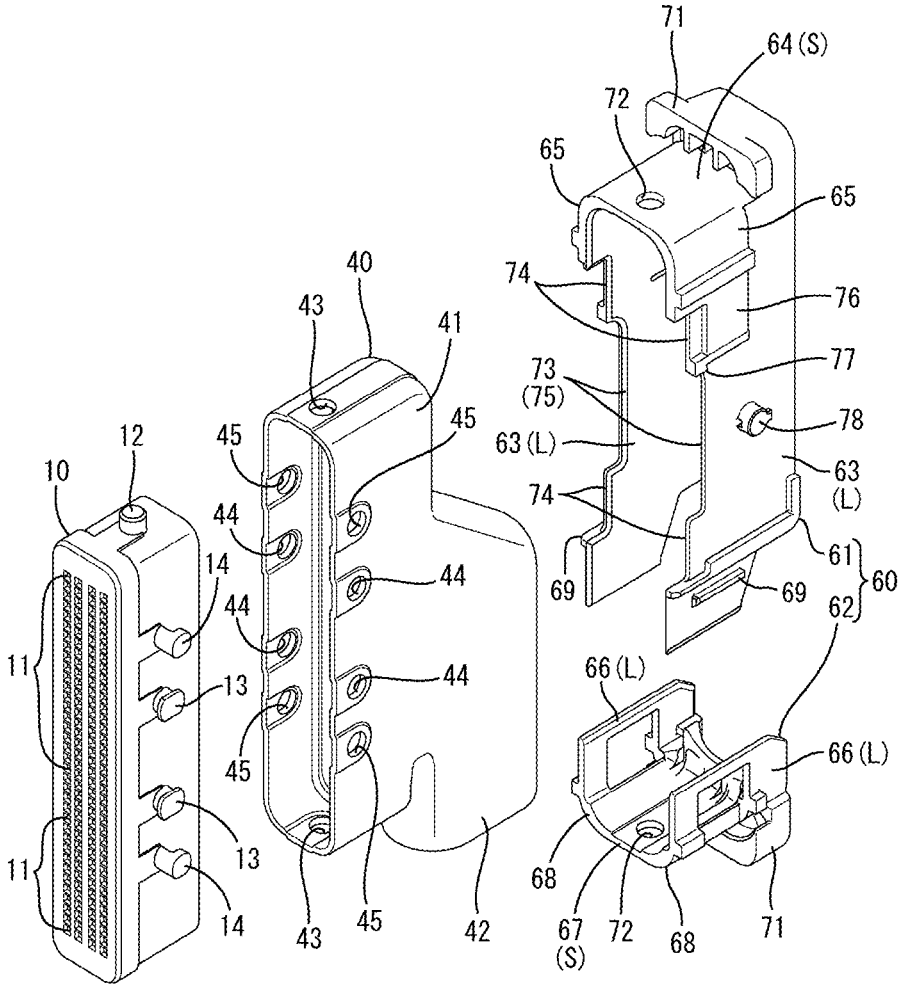
FIG. 1 is an exploded perspective view of a connector according to a first embodiment except a lever.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Embodiments of Invention

First, embodiments of the present disclosure are listed and described.

(1) The connector of the present disclosure is provided with a housing, a grommet arranged to cover an outer periphery of the housing, and a grommet cover arranged to cover an outer periphery of the grommet, wherein the grommet cover includes a tip portion on one end on an opening side, the housing includes a restricting portion, the restricting portion includes a recess, the tip portion of the grommet cover being arranged inside the recess, and the recess of the restricting portion includes a restricting body arranged to face an outer side of the tip portion of the grommet cover. According to this configuration, the grommet cover can be easily assembled with the housing by inserting the tip portion of the grommet cover inside the recess. Further, outward deformation of the grommet cover can be reliably prevented by the contact of the tip portion of the grommet cover with the restricting body of the recess.

(2) Preferably, the grommet cover includes a body cover and a lid cover, and the body cover and the lid cover are coupled to each other with the grommet sandwiched therebetween. According to this configuration, the grommet cover can cover the outer periphery of the grommet over the entire periphery.

If an outward deformation force is applied to the grommet cover, the body cover and the lid cover may be divided by being released from a state coupled to each other. However, since the outward deformation of the grommet cover is prevented by the contact of the tip portion of the grommet cover with the restricting body of the recess in this configuration, a situation where the body cover and the lid cover are inadvertently divided can be avoided.

(3) The grommet cover may be formed into a tubular shape and may include a pair of facing short side portions and a pair of long side portions facing each other in a direction orthogonal to the both short side portions and longer than the short side portions, and parts of the tip portion of the grommet cover to be arranged inside the recess may be provided on the pair of long side portions. The both long side portions are longer than the both short side portions and are easily deflected and deformed. In that respect, according to this configuration, outward deflection and deformation of the both long side portions can be reliably prevented by the contact of tip portions of the both long side portions with the restricting body of the recess.

(4) The pair of long side portions may be provided with support shafts and a lever for promoting connection of the housing and a mating connector may be rotatably mounted on the support shafts, and parts of the tip portion of the grommet cover to be arranged inside the recess may be provided on opposite longitudinal sides of the pair of long side portions across the support shafts. Since a rotational force of the lever acts on the support shafts, the both long side portion are more easily deflected and deformed outward. In that respect, since the tip portions to be arranged inside the recess are provided on the opposite longitudinal sides of the both long side portions across the support shafts according to this configuration, the outward deflected and deformation of the both long side portions can be more reliably prevented.

(5) The restricting portion may be shaped to project on an outer surface of the housing, and the grommet may include an insertion hole, the restricting portion being inserted into the insertion hole. A positional deviation of the grommet with respect to the housing can be prevented by the insertion of the restricting portion into the insertion hole of the grommet. The restricting portion can have both a function preventing the deformation of the grommet cover and a function of preventing a positional deviation of the grommet. Thus, the configuration of the housing can be simplified as compared to the case where the both functions are separately provided.

Details of Embodiments of Present Disclosure

Specific examples of the connector of the present disclosure are described below with reference to the drawings. Note that the present invention is not limited to these illustrations and is intended to be represented by claims and include all changes in the scope of claims and in the meaning and scope of equivalents.

First Embodiment

A connector of this embodiment includes a housing 10, a grommet 40 and a grommet cover 60 as shown in FIG. 1. The connector also includes a lever 90 as shown in FIG. 3. The housing 10 is connectable to a mating connector. In the following description, surface sides facing each other at the start of connection of the housing 10 to the mating connector are referred to as front sides concerning a front-rear direction. A vertical direction is based on a vertical direction of FIGS. 1 to 3 and 5.

Mating Connector

Figure 2:
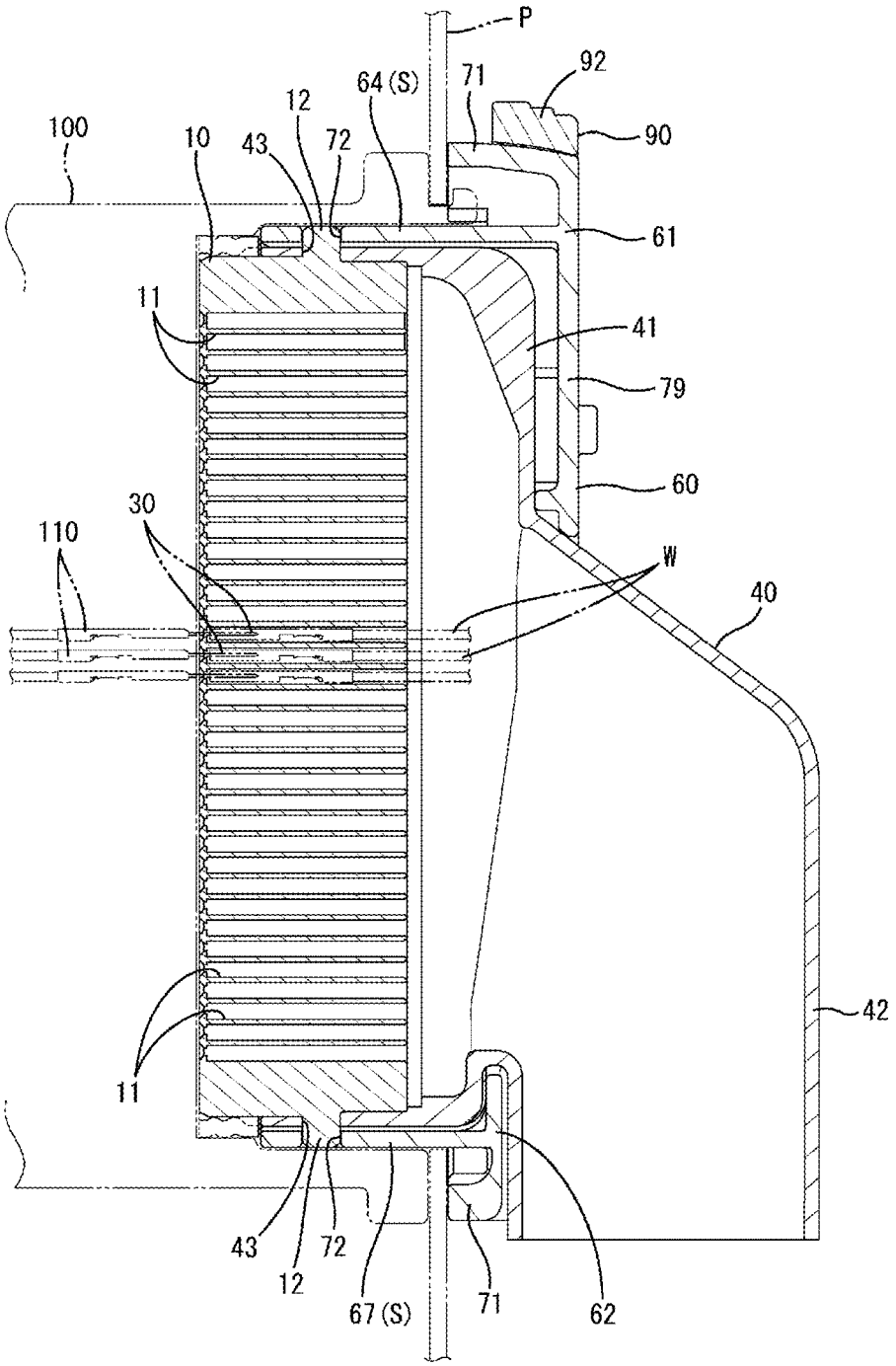
FIG. 2 is a side view in section of the connector in which the lever is at a connection position.
Figure 3:
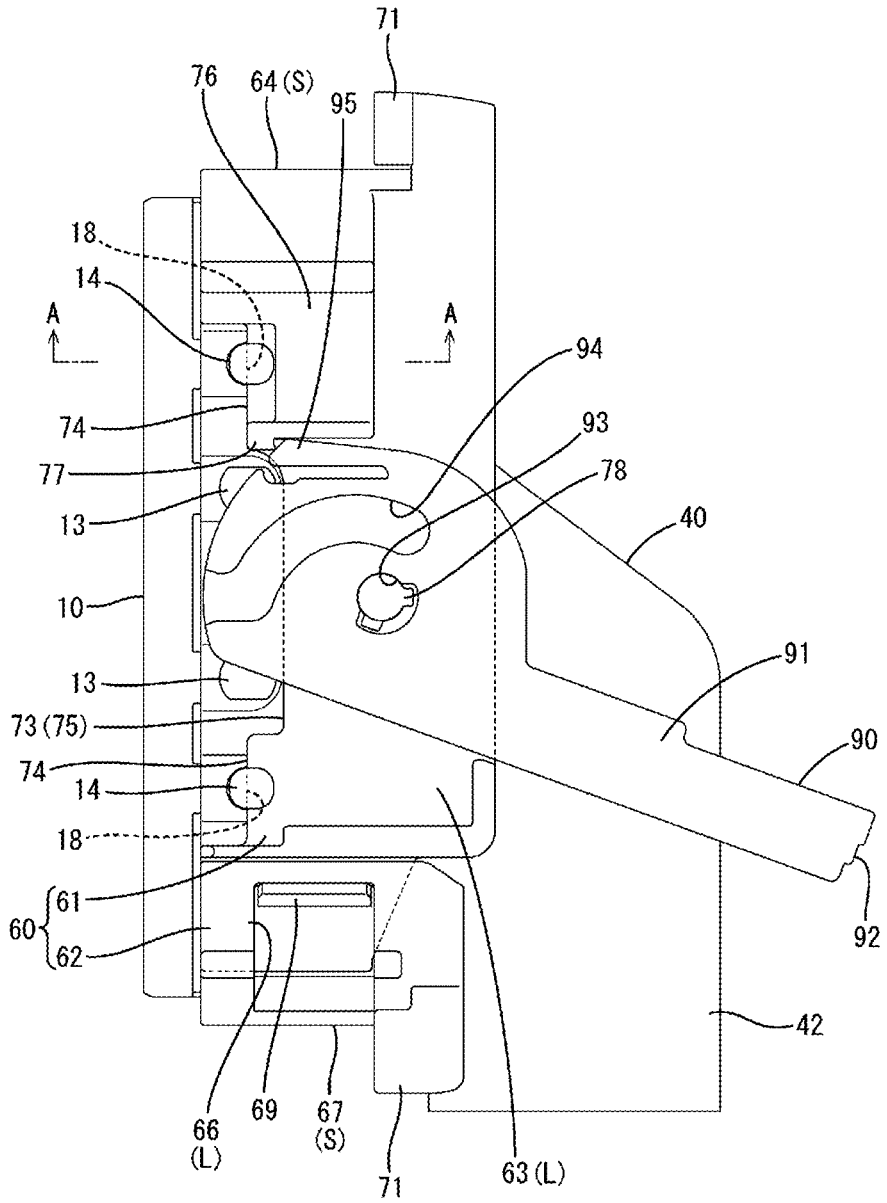
FIG. 3 is a side view of the connector in which the lever is at an initial position.

As shown in FIG. 2, the mating connector includes a mating housing 100 and mating terminal fittings 110 to be accommodated into the mating housing 100. The mating housing 100 is made of synthetic resin and in the form of a rectangular tube elongated in the vertical direction. A plurality of the mating terminal fittings 110 are arranged in the mating housing 100. The mating terminal fittings 100 include tab parts projecting into the mating housing 100.

Housing

Figure 5:
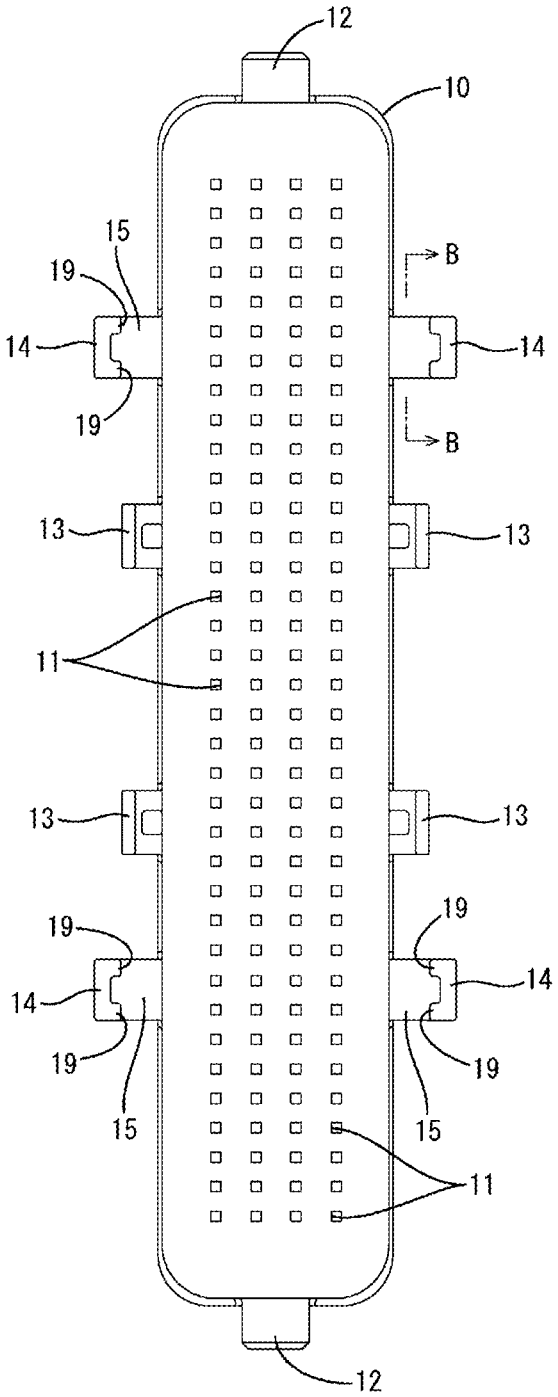
FIG. 5 is a back view of a housing.

The housing 10 is made of synthetic resin and, as shown in FIGS. 1 and 5, in the form of a rectangular block elongated in the vertical direction. Lateral dimensions of the upper and lower surfaces of the housing 10 are smaller than vertical dimensions of left and right side surfaces (both side surfaces) of the housing 10. As shown in FIG. 2, the housing 10 is inserted into the mating housing 100 at the time of connection.

The housing 10 includes a plurality of cavities 11. A terminal fitting 30 is inserted and accommodated into each cavity 11. As shown in FIG. 2, the respective terminal fittings 30 are connected to the respective mating terminal fittings 110 with the housing 10 connected to the mating connector. The terminal fitting 30 includes a tubular part to be fit to the tab part of the mating terminal fitting 110 and is connected to an end part of a wire W.

As shown in FIG. 5, the housing 10 includes a pair of first protrusions 12 in laterally central parts of the upper and lower surfaces. The first protrusions 12 are formed into a cylindrical shape.

The housing 10 includes a pair of second protrusions 14 at vertically spaced-apart positions on each of the both side surfaces. The tip surface of the second protrusion 13 in a projecting direction (lateral direction, in-out direction) is formed to be flat in the front-rear direction and the vertical direction. A flange part protruding forward and rearward is provided on the tip surface of the second protrusion 13 in the projecting direction as shown in FIG. 1.

As shown in FIG. 5, the housing 10 includes a pair of restricting portions 14 at upper and lower positions across the upper and lower second protrusions 13 on each of the both side surfaces. The respective restricting portions 14 are formed to project on the both side surfaces of the housing 10. The tip surface of the restricting portion 14 in a projecting direction is formed to be flat in the front-rear direction and the vertical direction. A projecting dimension of the restricting portion 14 is larger than that of the second protrusion 13. The respective restricting portions 14 and the respective second protrusions 13 are arranged side by side on the same axis in the vertical direction in front parts of the side surfaces of the housing 10 as shown in FIG. 1.

Figure 4:
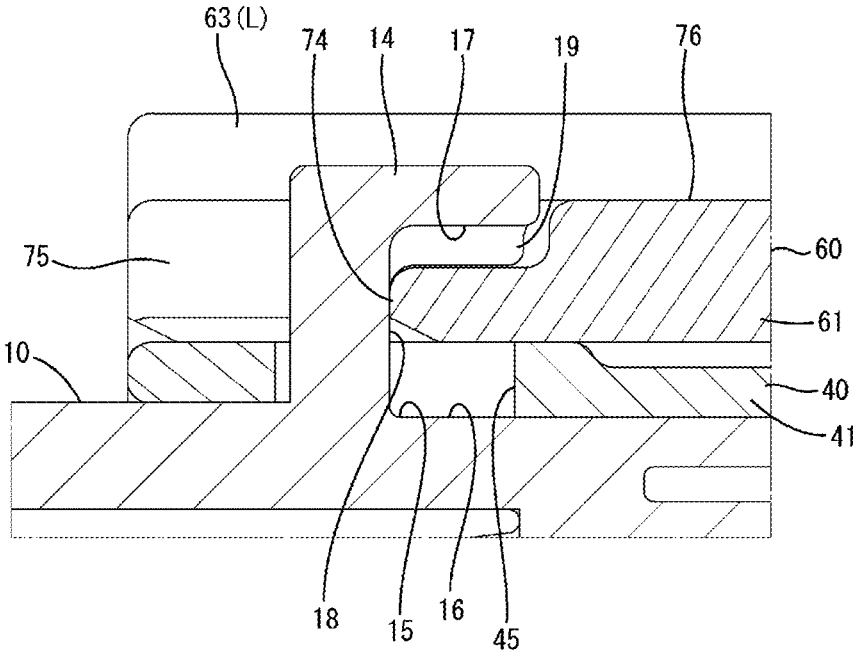
FIG. 4 is a section along A-A of FIG. 3.
Figure 7:
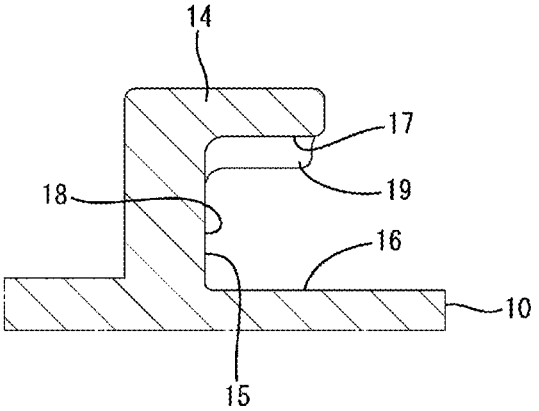
FIG. 7 is a section along C-C of FIG. 6.

The restricting portion 14 is formed into a cylindrical shape as a whole. As shown in FIGS. 4 and 7, the restricting portion 14 includes a recess 15 in a lower part on a rear side. The recess 15 is open in the rear surface and upper and lower surfaces of the restricting portion 14. The inner surface of the recess 15 includes a base surface 16 continuous with the side surface of the housing 10 without any step, a facing surface 17 facing in parallel to the base surface 16 and a back surface 18 arranged along a lateral direction and the vertical direction between the facing surface 17 and the base surface 16. In the case of this embodiment, a recessed amount (distance from the rear end of the restricting portion 14 to the back surface 18) of the recess 15 is larger than a radius of the restricting portion 14.

Figure 6:
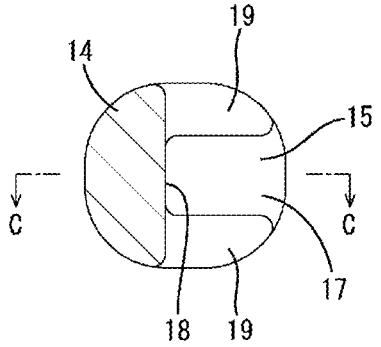
FIG. 6 is a section along B-B of FIG. 5.

As shown in FIG. 6, the restricting portion 14 includes a pair of restricting bodies 19 at upper and lower positions of the facing surface 17 of the recess 15. Each restricting body 19 is in the form of a rib extending in the front-rear direction. As shown in FIG. 4, the end surface of the restricting body 19 is formed to be flat along the front-rear direction and can contact a later-described tip portion 74 of the grommet cover 60 from outside.

Grommet

The grommet 40 is made of rubber and includes, as shown in FIG. 1, a grommet body 41 in the form of a rectangular tube elongated in the vertical direction and open forward, and a pipe-like draw-out portion 42 projecting rearward from the rear wall of the grommet body 41 and further extending downward. The grommet 40 is arranged to cover the outer peripheral surface and rear surface of the housing 10.

Upper and lower walls of the grommet body 41 are held in close contact with the upper and lower surfaces of the housing 10. Left and right side walls (both side walls) of the grommet body 41 are held in close contact with the both side surfaces of the housing 10. As shown in FIG. 2, the draw-out portion 42 communicates with the inside of the grommet body 41 and bends the respective wires W pulled out from the rear surface of the housing 10 downwardly. The respective wires W are drawn out downward from an opening in the lower end of the draw-out portion 42.

As shown in FIG. 1, the grommet body 41 includes a pair of first locking holes 43 in the upper and lower walls. The first locking hole 43 has a circular opening and has such an opening diameter that the first protrusion 12 can be fit thereinto as shown in FIG. 2. As shown in FIG. 1, the grommet body 41 includes a pair of second locking holes 44 at vertically spaced-apart positions in each of the both side walls. The second locking hole 44 has a circular opening and has such an opening diameter that the second protrusion 13 can be fit thereinto.

The grommet body 41 includes a pair of insertion holes 45 at upper and lower positions across the upper and lower second locking holes 44 in each of the both side walls. The insertion hole 45 has a circular opening and has such an opening diameter that the restricting portion 14 can be fit thereinto as shown in FIG. 4. As shown in FIG. 1, the respective insertion holes 45 and the respective second locking holes 44 are arranged side by side on the same axis in the vertical direction in front parts of the side walls of the grommet body 41. Note that the insertion holes 45 and the second locking holes 44 have the same opening diameter.

Grommet Cover

The grommet cover 60 is made of synthetic resin and, as shown in FIG. 1, formed into a tubular shape elongated in the vertical direction and penetrating in the front-rear direction. The grommet cover 60 can be divided into a body cover 61 and a lid cover 62. As shown in FIG. 2, the lid cover 62 is arranged to cover a lower part of the grommet body 41. The body cover 61 is arranged to cover a main part of the grommet body 41 (part more than half the grommet body 41) except the lower part.

As shown in FIG. 1, the body cover 61 is gate-shaped in a front view and includes a pair of left and right side plate portions 63, an upper plate portion 64 and curved upper corner portions 65 connecting the both side plate portions 63 and the upper plate portion 64 between the both plate portions 63, 64. The upper plate portion 64 is arranged along the lateral direction. The both side plate portions 63 are arranged along the vertical direction. The body cover 61 also includes a back plate portion 79 orthogonal to the both side plate portions 63 and the upper plate portion 64 and extending along the vertical direction to cover the rear surface of the rear wall of the grommet body 41 as shown in FIG. 2.

As shown in FIG. 1, the lid cover 62 is U-shaped in a front view and includes a pair of left and right lock plate portions 66 arranged along the vertical direction, a lower plate portion 67 and curved lower corner portions 68 connecting the both lock plate portions 66 and the lower plate portion 67 between the both plate portions 66, 67. The lower plate portion 67 is arranged along the lateral direction. The both lock plate portions 66 are arranged along the vertical direction.

The both side plate portions 63 and the both lock plate portions 66 constitute a pair of left and right long side portions L arranged to be long in the vertical direction. The upper plate portion 64 and the lower plate portion 67 constitute a pair of short side portions S arranged to be short in the lateral direction orthogonal to a longitudinal direction of the long side portions L.

As shown in FIGS. 1 and 3, the both side plate portions 63 include rib-like lock portions 69 extending in the front-rear direction on lower end parts. The both lock plate portions 66 are formed into a gate-shaped frame rising upward. The lock plate portion 66 is deflectable and deformable inwardly and outwardly with a part on the side of the lower plate portion 67 as a fulcrum. As shown in FIG. 3, the lock portion 69 is fit and locked inside the lock plate portion 66. In this way, the both lock plate portions 66 are coupled to and held on lower end parts of the both side plate portions 63.

As shown in FIGS. 1 and 2, the upper plate portion 64 and the lower plate portion 67 are provided with a pair of upper and lower protruding portions 71. As shown in FIG. 2, the front surface of the protruding portion 71 is arranged to face a panel P. Note that the connector is mounted on the panel P while being connected to the mating housing 100.

Further, as shown in FIGS. 1 and 2, the upper plate portion 64 and the lower plate portion 67 are provided with a pair of upper and lower through holes 72. The through hole 72 has a circular opening and is arranged to communicate with the first locking hole 43 as shown in FIG. 2. Each first protrusion 12 is fit into each through hole 72.

As shown in FIG. 1, the both side plate portions 63 include a pair of left and right recesses 73 recessed rearward from both upper and lower end parts in vertically central parts. Each of the both side plate portions 63 includes a pair of tip portions 74 at upper and lower positions of the back end of the recess 73.

The tip portions 74 are front edge parts (opening end part) of the side plate portion 63 and arranged along the vertical direction. The recess 73 includes a retraction recess 75 retracted further rearward than the upper and lower tip portions 74 between the tip portions 74. The both side plate portions 63 include thick portions 76 having a large thickness behind and adjacent to the upper tip portions 74 via steps. The both side plate portions 63 include locking projections 77 orthogonal to the tip portions 74 on lower end parts of the thick portions 76.

The both side plate portions 63 are provided with a pair of left and right support shafts 78 projecting behind the retraction recesses 75 in the vertically central parts. The support shafts 78 are formed into a cylindrical shape.

Lever

The lever 90 is made of synthetic resin, in the form of a gate-shaped plate and includes, as shown in FIG. 3, a pair of left and right arm portions 91 (only one is shown in FIG. 3) and a coupling portion 92 coupling the both arm portions 91 and extending along the lateral direction. The both arm portions 91 are provided with penetrating bearing holes 93. Cam grooves 94 extending in a curved manner and open in outer peripheries are provided in the outer surfaces of the both arm portions 91. The lever 90 is arranged to straddle the draw-out portion 42 of the grommet 40 and the body cover 61 of the grommet cover 90 from behind. The support shafts 78 are fit into the bearing holes 93 of the both arm portions 91. The lever 90 is rotatable from an initial position to a connection position about the bearing holes 93 (support shafts 78). As shown in FIG. 3, at the initial position, the entrances of the cam grooves 92 are facing forward and the coupling portion 92 is arranged behind the draw-out portion 42 of the grommet 40. As shown in FIG. 2, the coupling portion 92 is arranged on the protruding portion 71 of the body cover 61.

Deflectable and deformable resilient pieces 95 are provided on outer peripheral sides of the both arm portions 91. As shown in FIG. 3, the resilient pieces 95 lock the locking projections 77 of the grommet cover 60. In this way, the lever 90 is held at the initial position.

When the lever 90 is at the initial position, unillustrated cam followers of the mating housing 100 are inserted in the entrances of the cam grooves 94. The locking of the resilient pieces 95 and the locking projections 77 is released by unillustrated releasing portions of the mating housing 100. In this way, the lever 90 becomes rotatable to the connection position. If the lever 90 is rotated toward the connection position, the cam followers slide on groove surfaces of the cam grooves 94 to exhibit a cam action and the mating housing 100 is pulled toward the housing 10 with a low connection force. When the lever 90 reaches the connection position, the both housings 10, 100 are held in a properly connected state.

Assembling Structure of Connector

In assembling, the grommet 40 is mounted on the housing 10 from behind. The opening end side (front end side) of the grommet body 41 is resiliently restored from an expanded state, whereby the both first protrusions 12 can be fit into the both first locking holes 43 (see FIG. 2), the respective second protrusions 13 can be fit into the respective second locking holes 44 and the respective restricting portions 14 can be fit into the respective insertion holes 45. Then, the both first protrusions 12 lock the both first locking holes 43, the respective second protrusions 13 lock the respective second locking holes 44 and the respective restricting portions 14 lock the respective insertion holes 45, whereby the grommet 40 is retained and held on the housing 10.

Subsequently, the grommet cover 60 is assembled with the housing 10 with the grommet 40 sandwiched therebetween.

The body cover 61 is put on the grommet 40 from above. Then, the upper first protrusion 12 is fit into the through hole 72 of the upper plate portion 64 (see FIG. 2), and the upper plate portion 64 contacts the upper wall of the grommet 40. Each tip portion 74 is inserted into the recess 15 of the corresponding restricting portion 14 and arranged to vertically cross the recess 15 along the back surface 18 (see FIG. 3). Further, the respective second protrusions 13 enter the left and right retraction recesses 75 to escape. Here, the body cover 61 is displaced from an obliquely inclined state to a proper assembly posture along the vertical direction, whereby the respective tip portions 74 can be inserted into the recesses 15 from behind and the interference of the body cover 61 and the respective second protrusions 13 can be avoided.

On the other hand, the lid cover 62 is put on the grommet 40 from below. Then, the lower first protrusion 12 is fit into the through hole 72 of the lower plate portion 67 (see FIG. 2), and the lower plate portion 67 contacts the lower wall of the grommet 40. Simultaneously, the both lock plate portion portions 66 lock the both lock portions 69 and the body cover 61 and the lid cover 62 are held in a separation restricted state (see FIG. 3).

Subsequently, the lever 90 is assembled with the grommet cover 60. By fitting the both support shafts 78 into the bearing holes 93 of the both arm portions 91, the lever 90 is supported rotatably about the both support shafts 78. Front parts of the both arm portions 91 are arranged outside the retraction recesses 75 (see FIG. 3). The tip surfaces of the respective second protrusions 13 in the projecting direction are arranged to face the inner surfaces of the both arm portions 91 with clearances formed therebetween. Thereafter, the connector is connected to the mating connector by a rotating operation of the lever 90.

When the lever 90 is rotated, an operation force of the lever 90 is applied to the grommet cover 60 via the support shafts 78. Thus, the front end parts (opening end parts) of the both side plate portions 63 may be deformed to expand outward.

However, in the case of this embodiment, the tip portions 74 are provided on both upper and lower sides (opposite longitudinal sides) across the support shafts 78 (see FIG. 3). The tip portions 74 are so arranged that the outer surfaces thereof face and contact the end surfaces of the restricting bodies 19 along the front-rear direction (see FIG. 4). Thus, the both side plate portions 63 can be prevented from being deformed to expand outward by the contact of the tip portions 74 with the end surfaces of the restricting bodies 19. Particularly, in the case of this embodiment, since the tip portions 74 configured to contact the restricting bodies 19 are the front end parts (opening end parts) of the both side plate portions 63, the deformation of the both side plate portions 63 can be efficiently and reliably prevented.

Further, the tip portions 74 are inserted into the recesses 15 from behind in the process of assembling the body cover 61 with the housing 10. Thus, the interference of the grommet cover 60 with the restricting portions 14 in the assembling process can be avoided and good assemblability can be ensured.

Furthermore, a situation where the body cover 61 and the lid cover 62 are inadvertently divided can be avoided by preventing the deformation of the both side plate portions 63. In addition, a positional deviation of the grommet 40 with respect to the housing 10 can also be prevented by inserting the restricting portions 14 into the insertion holes 45.

Second Embodiment

Figure 8:
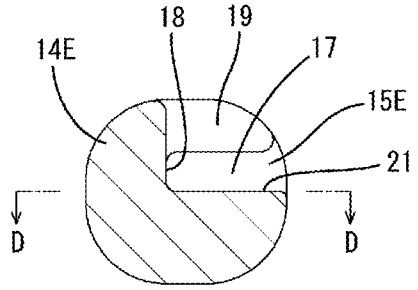
FIG. 8 is a view, corresponding to FIG. 6, of a connector according to a second embodiment.
Figure 9:
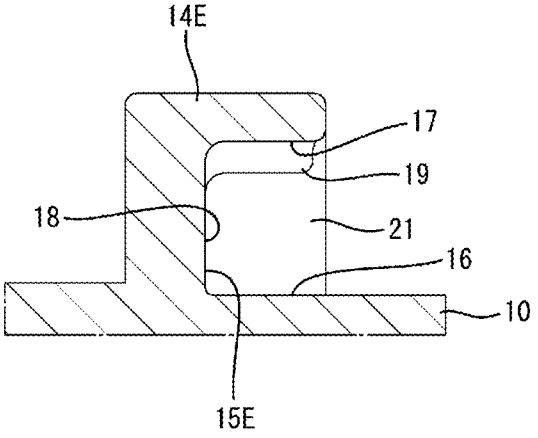
FIG. 9 is a section along D-D of FIG. 8.

FIGS. 8 and 9 show a second embodiment. The second embodiment differs from the first embodiment in the shape of recesses 15E of restricting portions 14E.

The recess 15E of the second embodiment is open only in the rear surface of the restricting portion 14E and either one of the upper and lower surfaces of the restricting portion 14E. The recess 15E has a closed surface 21 on the other one of the upper and lower surfaces of the restricting portion 14E.

The recess 15E is formed into an L shape by cutting a quarter part (90° part) of the restricting portion 14E in a cross-section obtained by cutting the restricting portion 14E in a direction orthogonal to a projecting direction of the restricting portion 14E (cross-section shown in FIG. 8 (slice cross-section)). With a tip portion 74 of a grommet cover 60 arranged in the recess 15E, the tip portion 74 is prevented from being displaced outward by contact with a restricting body 19 as in the first embodiment and, in addition, can contact the closed surface 21. In this way, a positional deviation of the grommet cover 60 toward the closing surface 21 is restricted.

For example, if, out of the upper and lower recesses 15E, the upper recesses 15E are open in the lower surfaces of the restricting portions 14E and the lower recesses 15E are open in the upper surfaces of the restricting portions 14E, upward positional deviations of the tip portions 74 are restricted by contact with the closed surfaces 21 of the upper recesses 15E and downward positional deviations of the tip portions 74 are restricted by contact with the closed surfaces 21 of the lower recesses 15E. In this way, the grommet cover 60 is held with vertical positional deviations thereof with respect to the housing 10 restricted. Note that other structures of the second embodiment are similar to those of the first embodiment and repeated description is omitted.

Other Embodiments of Present Disclosure

The embodiments disclosed this time should be considered to be illustrative rather than restrictive in all aspects.

Although the pair of upper and lower restricting portions are provided on each side surface of the housing in the case of the above embodiments, one, three or more restricting portions may be provided on each side surface of the housing while being vertically spaced apart as another embodiment.

Although the restricting portion is formed into a cylindrical shape as a whole in the case of the above embodiments, a restricting portion may be formed into a rectangular column shape as a whole as another embodiment.

Although the restricting bodies are in the form of ribs extending in the front-rear direction on the facing surface (inner surface) of the recess in the case of the above embodiments, restricting bodies may not have any special shape and may be configured by a facing surface (inner surface) of a recess as another embodiment.

Although the body cover and the lid cover are dividably provided in the case of the above embodiments, a body cover and a lid cover may be integrally provided via a hinge as another embodiment. Further, a grommet cover may be configured as a single member without distinguishing a body cover and a lid cover.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a housing;

a grommet arranged to cover an outer periphery of the housing; and a grommet cover arranged to cover an outer periphery of the grommet, wherein:

the grommet cover includes a tip portion on one end on an opening side, the housing includes a restricting portion, the restricting portion includes a recess, the tip portion of the grommet cover being arranged inside the recess, and the recess of the restricting portion includes a restricting body arranged to face an outer side of the tip portion of the grommet cover.

2. The connector of claim 1, wherein:

the grommet cover includes a body cover and a lid cover, and the body cover and the lid cover are coupled to each other with the grommet sandwiched therebetween.

3. The connector of claim 1, wherein:

the grommet cover is formed into a tubular shape and includes a pair of facing short side portions and a pair of long side portions facing each other in a direction orthogonal to the both short side portions and longer than the short side portions, and parts of the tip portion of the grommet cover to be arranged inside the recess are provided on the pair of long side portions.

4. The connector of claim 3, wherein:

the pair of long side portions are provided with support shafts and a lever for promoting connection of the housing and a mating connector is rotatably mounted on the support shafts, and parts of the tip portion of the grommet cover to be arranged inside the recess are provided on opposite longitudinal sides of the pair of long side portions across the support shafts.

5. The connector of claim 1, wherein the restricting portion is shaped to project on an outer surface of the housing, and the grommet includes an insertion hole, the restricting portion being inserted into the insertion hole.

* * * * *